US011313156B2

(12) United States Patent
Stojc et al.

(10) Patent No.: US 11,313,156 B2
(45) Date of Patent: Apr. 26, 2022

(54) DELAYED EMERGENCY RELEASE UNIT

(71) Applicant: Westinghouse Air Brake Technologies Corporation, Wilmerding, PA (US)

(72) Inventors: Andre Stojc, Ile Bizard (CA); Daniel Filion, Prevost (CA)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 1058 days.

(21) Appl. No.: 15/765,791

(22) PCT Filed: Oct. 31, 2016

(86) PCT No.: PCT/US2016/059674
§ 371 (c)(1),
(2) Date: Apr. 4, 2018

(87) PCT Pub. No.: WO2017/079084
PCT Pub. Date: May 11, 2017

(65) Prior Publication Data

US 2018/0283057 A1 Oct. 4, 2018

Related U.S. Application Data

(60) Provisional application No. 62/250,550, filed on Nov. 4, 2015.

(51) Int. Cl.
*E05B 81/08* (2014.01)
*E05B 79/20* (2014.01)
(Continued)

(52) U.S. Cl.
CPC ..... *E05B 81/08* (2013.01); *B61B 13/00* (2013.01); *B61D 19/007* (2013.01);
(Continued)

(58) Field of Classification Search
CPC ..... E05B 81/08; E05B 81/04; E05B 81/02; E05B 81/90; E05B 79/20; E05B 83/363;
(Continued)

(56) References Cited

U.S. PATENT DOCUMENTS 4,752,092 A * 6/1988 Faust ..... E05B 79/20 292/201
5,044,678 A * 9/1991 Detweiler ..... E05B 79/20 292/144
(Continued)

FOREIGN PATENT DOCUMENTS

DE 19924028 A1 * 11/2000 ..... E05B 83/40
EP 0736655 A1 10/1996
EP 1365095 A2 11/2003
FR 2635493 A1 * 2/1990 ..... E05B 47/0603

*Primary Examiner* — Alyson M Merlino
(74) *Attorney, Agent, or Firm* — The Small Patent Law Group LLC; Mary D. Lawlor

(57) ABSTRACT

The manual release mechanism described herein enables a passenger to attempt to manually open the transit door, but delays opening until the vehicle is no longer moving. A motion transfer device (14) moves to an unlocking position of the door lock (10) only when the manual release mechanism is activated to store energy in a mechanical energy storage device (40), and an electromechanical device (26) is de-energized to release the motion transfer device (14).

20 Claims, 4 Drawing Sheets

(51) Int. Cl.

| | |
|---|---|
| ***E05B 83/36*** | (2014.01) |
| ***E05B 47/00*** | (2006.01) |
| ***E05B 47/06*** | (2006.01) |
| ***B61B 13/00*** | (2006.01) |
| ***B61D 19/00*** | (2006.01) |
| ***B61D 19/02*** | (2006.01) |

(52) U.S. Cl.
CPC ..... *B61D 19/023* (2013.01); *E05B 47/0006* (2013.01); *E05B 47/06* (2013.01); *E05B 79/20* (2013.01); *E05B 83/363* (2013.01)

(58) Field of Classification Search
CPC ..... E05B 83/40; E05B 77/54; E05B 47/06; E05B 47/0603; E05B 47/0002; E05B 47/0001; E05B 47/0006; E05C 2007/007; Y10T 292/1017; Y10T 292/1057; Y10T 292/11; Y10T 292/0908; Y10T 70/5173
See application file for complete search history.

(56) References Cited

U.S. PATENT DOCUMENTS

| | | | | |
|---|---|---|---|---|
| 5,076,622 | A * | 12/1991 | Detweiler | E05B 79/20 292/201 |
| 5,664,811 | A * | 9/1997 | Martus | E05B 83/34 292/144 |
| 2005/0235866 | A1 | 10/2005 | Stojc et al. | |
| 2007/0126243 | A1* | 6/2007 | Papanikolaou | E05B 79/20 292/201 |
| 2010/0123323 | A1 | 5/2010 | Geringer et al. | |
| 2010/0188177 | A1 | 7/2010 | Inage | |
| 2013/0140831 | A1* | 6/2013 | Kempel | E05B 83/26 292/3 |
| 2017/0016250 | A1* | 1/2017 | Sumegi | E05B 79/20 |
| 2018/0319410 | A1* | 11/2018 | Stojc | E05B 79/20 |

* cited by examiner

DELAYED EMERGENCY RELEASE UNIT

CROSS REFERENCE TO RELATED APPLICATIONS

This application claims the benefit to U.S. Provisional application. No. 62/250,550 filed Nov. 4, 2015, the disclosure of which is hereby incorporated in its entirety by reference.

BACKGROUND OF THE INVENTION

Field of the Invention

This invention relates to a manual emergency release mechanism for transit vehicle doors. It is essential that transit vehicle doors be locked during normal operation while the vehicle is moving so that a passenger leaning against or falling against a door does not push open the door and fall out of the vehicle. However, in an emergency, there must be a provision for unlocking the door. Certain Transit Authority operational procedures require the train to have reached full stop prior to allowing the doors to be unlocked, even in an emergency situation.

In the case of an emergency, a passenger actuates a release handle from inside the transit vehicle. The handle (rotating or linear motion) pulls on a release cable. The release cable is connected to the door actuator/lock mechanism to unlock the doors.

The manual release mechanism described herein enables a passenger to attempt to manually open the transit door, but delays opening until the vehicle is no longer moving.

FIG. 4 illustrates one of many types of transit vehicle doors. Specifically, FIG. 4 is a plan view of a typical slide-glide door. The door panels 50 move from the closed position to an open position generally perpendicular to the closed position. The door panels 50 are hung from a track 51 that is parallel to the closed door by a follower 52. The door is caused to open by rotation of a door post 56 connected to the leading edge (when opening) by a lever 57 extending from the door post 56. The door post 56 is caused to rotate by a door operator 53 via a connecting rod 54 and a bell crank 55.

A door lock may be associated with any number of the elements from the door operator to the door post and door panel.

DESCRIPTION OF RELATED ART

Usually, a manual release cable is coupled directly to a door locking mechanism and the door panels become unlocked when the cable is pulled. Unfortunately, if the train is still moving, stopped between stations, or the door is on the wrong side of the vehicle while adjacent a station platform, and if the door is manually unlocked, the passenger could get injured.

In the past, to prevent a passenger from leaving the car when unsafe to do so after the release handle has been actuated, the motor driving the doors was energized to attempt to keep the doors closed. However, the passenger with extra force can still force the doors open as the motors can only apply a limit amount of resistance force. Driving the doors in the closed position can cause the motors to overheat to their detriment. Also, the passenger can damage the door control mechanism when forcing the doors.

Also, in the past, a mechanism was provided to prevent the release handle from being moved so long as it is unsafe and, thus, the release cable from being pulled. However, this can frustrate the passenger and result in the handle being broken by the application of too much force. Also, when safe to do so, the passenger must again actuate the release handle. The passenger must know when it is safe to do so.

SUMMARY OF THE INVENTION

Briefly, according to this invention, there is provided an emergency manual door lock release mechanism for releasing a door lock actuator mechanism on a transit vehicle door comprising: a motion transfer device for releasing the door lock, an electromechanical device for fixing the position of the transfer device when energized and releasing the motion transfer device when de-energized, a mechanical energy storage device, a manual release device for energizing the mechanical energy storage device to bias the motion transfer device to move to an unlocking position, such that the door lock will only be manually released when the manual release device is activated to store energy in the mechanical energy storage device and the electromechanical device is de-energized to release the motion transfer device.

The motion transfer device may, for example, be a slide connected to a cable or lever connected to the door lock. The mechanical energy storage device may, for example, be a coil spring. The electromechanical device may, for example, be an electromagnet or solenoid. The manual release device may, for example, be a handle, cable, lever, or combination thereof.

Briefly, according to a specific embodiment of this invention, there is provided an emergency manual door lock release mechanism for releasing a door lock on a transit vehicle door comprising: a base plate for being secured to the transit vehicle, a sliding plate abutting and movable relative to the base plate, said sliding plate having at least one elongate slot, at least one pin fixed to the base plate extending into the at least one elongate slot constraining the relative movement between the base plate and sliding plate in a lateral direction, an electromagnet support bracket for being secured to the transit vehicle, an electromagnet supported by the electromagnet support bracket, a manual release cable, a first end bracket fixed at or near one lateral end of the base plate and having an aperture therein for receiving the sleeve of a manual release Bowden cable, a magnetizable steel plate, a second end bracket fixed at or near the opposite lateral end of the sliding plate from the first end bracket and supporting the magnetizable steel plate to be captured by the electromagnet, a coil spring that stores energy when stretched and which is anchored directly or indirectly at one end to the second end bracket and connected at the other end directly or indirectly to the manual release cable, the motion transfer means connected to the second end bracket, such that when the sliding plate moves away from the electromagnet, a door lock actuator mechanism will be manually released and the door unlocked only when the manual release cable is pulled to store energy in the coil spring, and the electromagnet is de-energized to release the magnetizable steel plate. The electromagnet electrical power is typically under the control of an ON/OFF signal issued by a combination of the train berthing system and the zero-speed system. When the train is properly berthed and at zero speed, the electromagnet is de-energized. It is energized whenever these conditions are not met.

Also, typically, there is a separate pull cable on the door lock actuating mechanism (not shown) allowing the door to be unlocked in normal service independently of the emergency release.

BRIEF DESCRIPTION OF THE DRAWINGS

Further features and other objects and advantages of the invention will become apparent from the following detailed description made with reference to the drawings.

DESCRIPTION OF THE INVENTION

Figure 1:
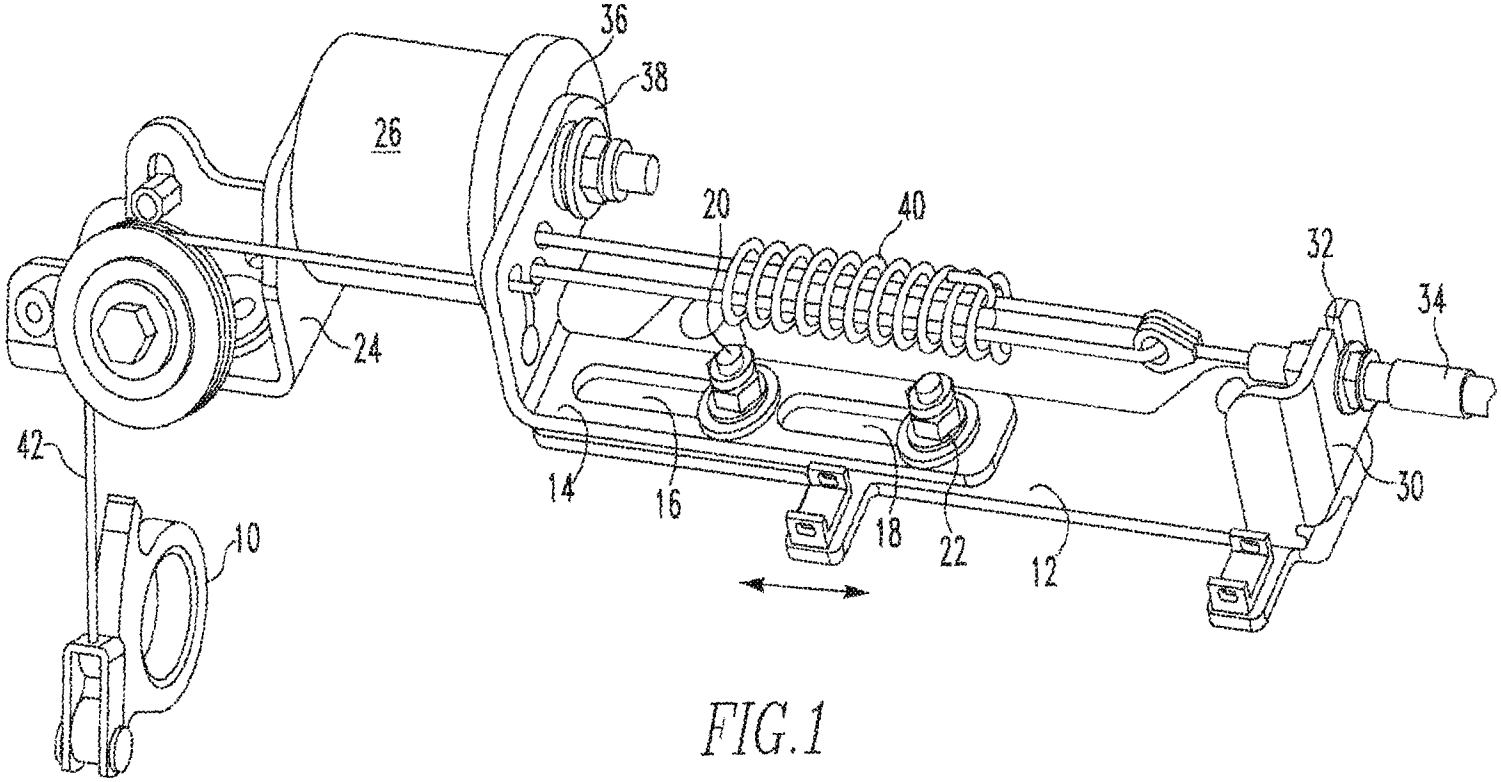
FIG. 1 is a schematic and prospective view of an emergency manual door lock release mechanism for releasing a door lock on a transit vehicle according to this invention when energy is not stored in the spring and release is not actuated.

Referring now to the drawings, an emergency manual door lock release mechanism for releasing a door lock element 10 on a transit vehicle door comprises a base plate 12 for being secured to a transit vehicle wall or frame. A sliding plate 14 abuts and is movable relative to the base plate 12. The sliding plate has at least one elongate slot 16, 18. At least one pin 20, 22 is fixed to the base plate 12 extending into the at least one elongate slot constraining the relative movement between the base plate and sliding plate in a lateral direction indicated by the double head arrow.

An electromagnet support bracket 24 is secured to the transit vehicle adjacent the base plate 12 near one lateral end. An electromagnet 26 is supported by the electromagnet support bracket 24.

A first end bracket 30 is fixed at or near one lateral end of the base plate 12 and has an aperture 32 therein for receiving the sleeve of a manual release Bowden cable 34. A second end bracket 38 is fixed at or near the opposite lateral end of the sliding plate 14 from the first bracket. The second end bracket positions a magnetizable steel plate 36 to be captured by the electromagnet 26.

A coil spring 40, which extends in the lateral direction, stores energy when stretched. The coil spring 40 is anchored directly or indirectly at one end to the second end bracket 38 and is connected at the other end directly or indirectly to the manual release cable 34. A motion transfer cable, lever, or bar 42 is connected to the second end bracket 38, such that when the sliding plate 14 moves away from the electromagnet 26, the door lock element 10 will be released only when the manual release cable 34 is pulled to store energy in the coil spring 40, and the electromagnet 26 is de-energized to release the magnetic plate 36.

As shown in FIG. 1, the coil spring 40 is relaxed and the electromagnet 26 is energized and the door is locked. This is the normal position when the transit vehicle is moving between stations.

Figure 2:
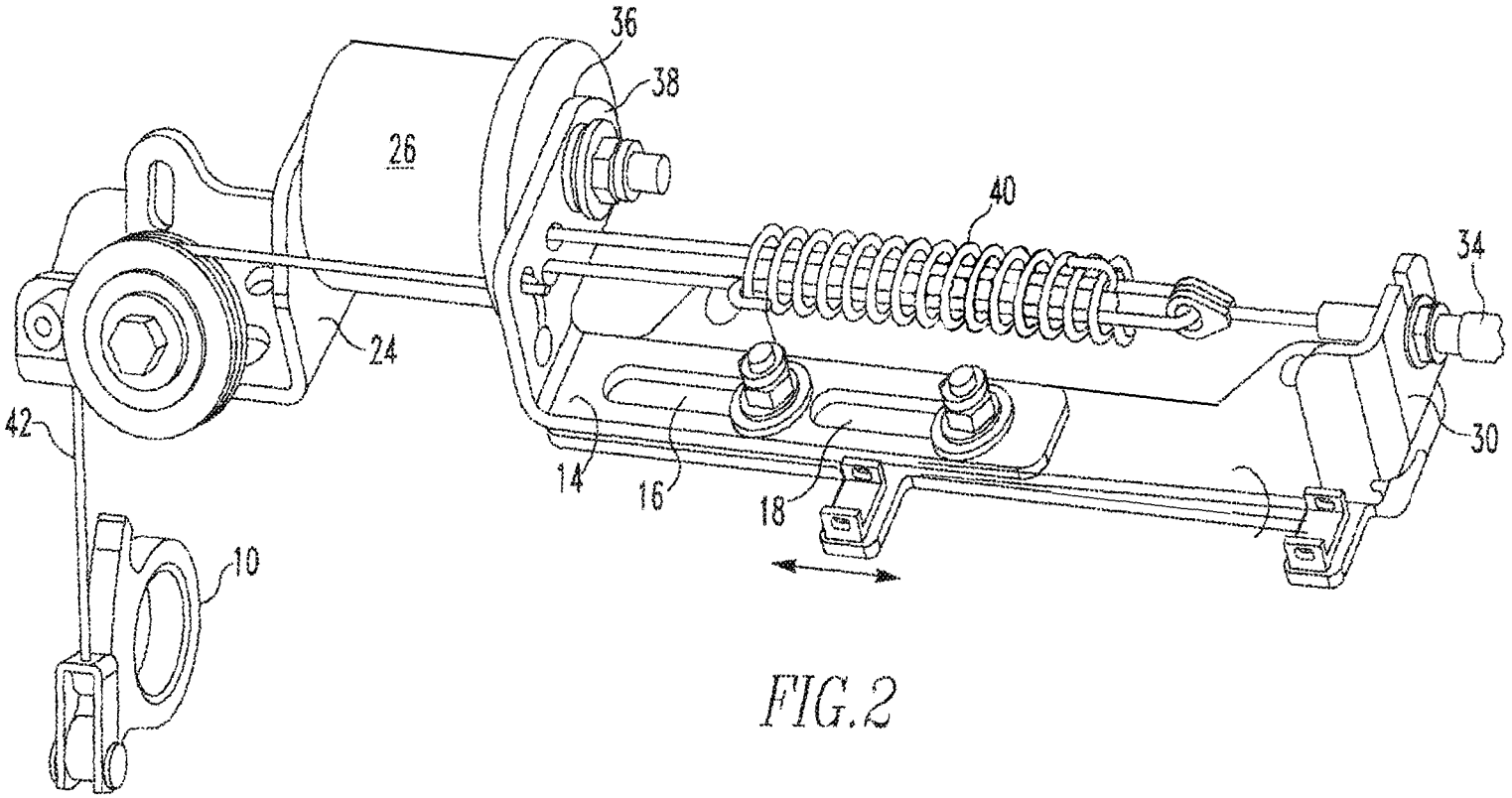
FIG. 2 is a schematic and prospective view of an emergency manual door lock release mechanism for releasing a door lock on a transit vehicle according to this invention with energy stored in the spring but the door lock is not released.

As shown in FIG. 2, the coil spring 40 is energized as a passenger, for example, has pulled the manual release cable 34, but the transit vehicle doors are not unlocked as the electromagnet is still energized. The manual release cable may be maintained pulled by a latch associated with the cable and first end plate.

Figure 3:
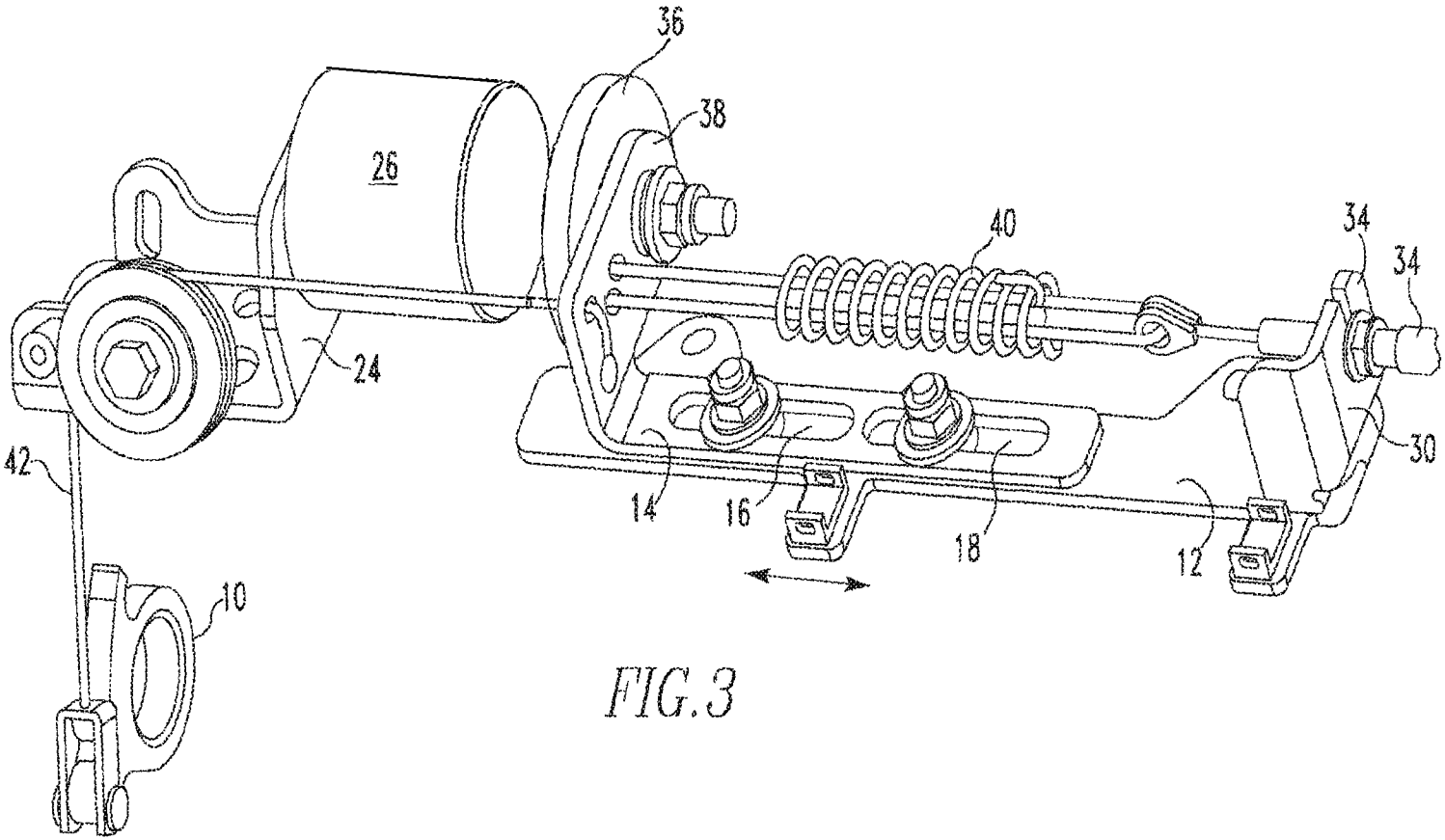
FIG. 3 is a schematic and prospective view of an emergency manual door lock release mechanism for releasing a door lock on a transit vehicle according to this invention when manual release has been attempted and the door lock has been released.
Figure 4:
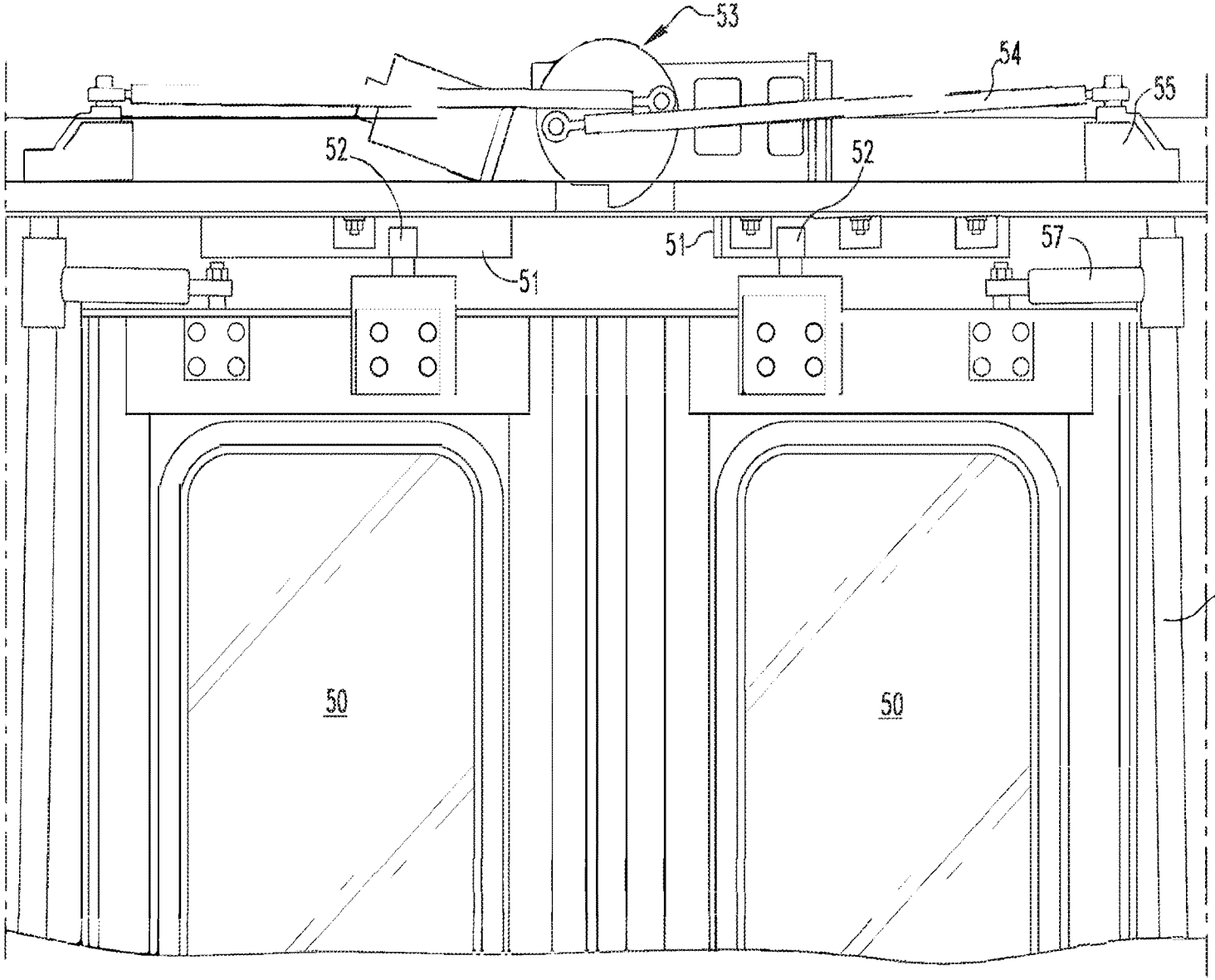
FIG. 4 PRIOR ART
FIG. 4 illustrates a transit vehicle with one of the many types of transit vehicle doors to which this invention has application.

As shown in FIG. 3, the electromagnet 26 is de-energized and the sliding late 14, under the bias of the coil spring 40, has moved the sliding plate 14 away from the electromagnet 26 pulling the motion transfer cable 42 to unlock the door lock element 10. Unlocking is delayed until the electromagnet 26 is de-energized when the transit vehicle comes to a stop.

Having thus defined our invention with the detail and particularity required by the Patent Laws, what is desired protected by Letters Patent is set forth in the following claims.

The invention claimed is:

1. A manual door lock release mechanism for releasing a door lock on a vehicle door, the manual door lock release mechanism comprising:

a base plate coupled with a vehicle including the vehicle door, the base plate comprising a first end bracket at a first end of the base plate, the first end bracket configured to receive a manual release device;

a sliding plate coupled with the base plate and configured to move in a lateral direction relative to the base plate, the sliding plate comprising a second end bracket disposed at a second end of the sliding plate that is opposite the first end of the base plate, the second end bracket operably coupled with a door lock element via a motion transfer device;

a magnetic plate operably coupled with the second end bracket of the sliding plate, the magnetic plate configured to be magnetized by an electromechanical device; and a spring extending between a first end operably coupled with the manual release device and a second end operably coupled with the magnetic plate;

wherein the electromechanical device is operably coupled with the magnetic plate and configured to change between an energized state and a de-energized state, wherein magnetic plate is prohibited to move away from the electromechanical device while the electromechanical device is in the energized state, and the magnetic plate is allowed to move away from the electromechanical device while the electromechanical device is in the de-energized state, and wherein the door lock element is configured to move to an unlocking position responsive to activation of the manual release device, wherein the activation of the manual release device energizes the spring to bias the motion transfer device to move the door locking element to the unlocking position while the electromechanical device is in the de-energized state.

2. An emergency manual door lock release mechanism for releasing a door lock on a vehicle door, the emergency manual door lock release mechanism comprising:

a base plate coupled with a vehicle including the vehicle door, the base plate including at least one pin extending from a surface of the base plate, the base plate including a first end bracket disposed at a first end of the base plate, the first end bracket comprising an aperture configured to receive a manual release cable;

a sliding plate abutting with the surface of the base plate, the sliding plate comprising at least one elongate slot configured to receive the at least one pin, the at least one pin configured to constrain sliding movement of the sliding plate in a lateral direction relative to the base plate, the sliding plate including a second end bracket that is disposed at a location opposite the first end of the base plate, the second end bracket of the sliding plate operably coupled with a door lock element via a motion transfer device;

an electromechanical device configured to change between an energized state and a de-energized state;

a magnetic plate operably coupled with the second end bracket of the sliding plate and disposed between the electromechanical device and the second end bracket of the sliding plate; and a spring that stores energy when stretched, the spring extending between a first end that is anchored to the second end bracket and a second end connected to the manual release cable, wherein, responsive to the electromechanical device being in the energized state, the magnetic plate is prohibited from moving away from the electromechanical device via activation of the manual release cable, and wherein, responsive to the electromechanical device being in the de-energized state, the magnetic plate moves away from the electromechanical device via the activation of the manual release cable, wherein the activation of the manual release cable energizes the spring to cause the sliding movement of the sliding plate relative to the base plate and move the magnetic plate away from the electromechanical device, to thereby activate movement of the motion transfer device, and move the door locking element to an unlocked position.

3. The manual door lock release mechanism of claim 1, the sliding plate further comprising an elongate slot configured to receive a pin of the base plate, wherein the pin received within the elongate slot is configured to allow movement of the sliding plate in the lateral direction and prohibit movement of the sliding plate in a second direction that is different than the lateral direction.

4. The manual door lock release mechanism of claim 3, wherein the elongate slot is a first elongate slot and the pin of the base plate is a first pin, the sliding plate further comprising a second elongate slot configured to receive a second pin of the base plate, wherein the first and second pins are configured to allow movement of the sliding plate in the lateral direction and prohibit movement of the sliding plate in the second direction.

5. The manual door lock release mechanism of claim 1, wherein the electromechanical device is configured to change between the energized state and the de-energized state based on conditions of the vehicle.

6. The manual door lock release mechanism of claim 5, wherein the conditions of the vehicle include whether the vehicle is stopped and whether the vehicle is berthed.

7. The manual door lock release mechanism of claim 5, wherein the electromechanical device is configured to change from the energized state to the de-energized state responsive to the conditions of the vehicle, the conditions including whether the vehicle is stopped and whether the vehicle is berthed.

8. The manual door lock release mechanism of claim 1, wherein the manual release device is configured to manually activated by a person onboard the vehicle.

9. The manual door lock release mechanism of claim 1, wherein the motion transfer device is one of a cable, a lever, or a bar.

10. The manual door lock release mechanism of claim 1, wherein the door lock element is configured to remain in a locking position responsive to the activation of the manual release device while the electromechanical device is in the energized state.

11. The manual door lock release mechanism of claim 1, wherein an amount of energy stored within the spring is configured to increase in response to the activation of the manual release device and the electromechanical device being in the energized state.

12. The emergency manual door lock release mechanism of claim 2, wherein the at least one elongate slot comprises a first elongate slot and a second elongate slot, and the at least one pin of the base plate comprises a first pin and a second pin, wherein the first and second pins are configured to allow movement of the sliding plate in the lateral direction and prohibit movement of the sliding plate in another direction.

13. The emergency manual door lock release mechanism of claim 2, wherein the conditions of the vehicle include whether the vehicle is stopped and whether the vehicle is berthed.

14. The emergency manual door lock release mechanism of claim 2, wherein the electromechanical device is configured to change from the energized state to the de-energized state responsive to the conditions of the vehicle, the conditions including whether the vehicle is stopped and whether the vehicle is berthed.

15. The emergency manual door lock release mechanism of claim 2, wherein the manual release cable is configured to manually activated by a person onboard the vehicle.

16. The emergency manual door lock release mechanism of claim 2, wherein the motion transfer device is one of a cable, a lever, or a bar.

17. The emergency manual door lock release mechanism of claim 2, wherein the door lock element is configured to remain in a locked position in response to the activation of the manual release cable while the electromechanical device is in the energized state.

18. The emergency manual door lock release mechanism of claim 2, wherein an amount of energy stored within the spring is configured to increase in response to the activation of the manual release cable and the electromechanical device being in the energized state.

19. The emergency manual door lock release mechanism of claim 2, wherein the sliding plate is prohibited from moving in the lateral direction in response to the activation of the manual release cable and the electromechanical device being in the energized state.

20. A door lock release mechanism comprising:

a bracket system comprising a base plate operably coupled with a sliding plate, the sliding plate configured to move in a lateral direction relative to the base plate, the base plate including a first end bracket disposed at a first end of the base plate and a second end bracket disposed at a second end of the sliding plate that is opposite the first end bracket, the first end bracket comprising a passage configured to receive a manual release cable;

an electromechanical system comprising an electromechanical device and a magnetic plate, the magnetic plate disposed between the electromechanical device and the second end bracket in the lateral direction, the electromechanical device configured to change between an energized state and a de-energized state;

a spring extending between a first end operably coupled with the manual release cable and a second end operably coupled with the magnetic plate; and a motion transfer device extending between the second end bracket and a door lock element, wherein, responsive to the electromechanical device being in the energized state, the magnetic plate is prohibited from moving away from the electromechanical device in response to activation of the manual release cable, and wherein, responsive to the electromechanical device being in the de-energized state, the magnetic plate is allowed to move away from the electromechanical device in response to the activation of the manual release cable, wherein the activation of the manual release cable causes movement of the spring and movement of the magnetic plate, thereby causing movement of the motion transfer device to move the door lock element from a locked position to an unlocked position.

* * * * *